United States Patent [19]

Grecksch et al.

[11] Patent Number: 4,641,740

[45] Date of Patent: Feb. 10, 1987

[54] BOBBIN TUBE MAGAZINE

[75] Inventors: Hans Grecksch; Hans-Werner Schwalm; Johannes Thomalla, all of Mönchengladbach, Fed. Rep. of Germany

[73] Assignee: W. Schlafhorst & Co., Mönchengladbach, Fed. Rep. of Germany

[21] Appl. No.: 549,576

[22] Filed: Nov. 7, 1983

[30] Foreign Application Priority Data

Nov. 6, 1982 [DE] Fed. Rep. of Germany ..... 3241032

[51] Int. Cl.[4] ..... B65G 47/90; B65G 17/06

[52] U.S. Cl. ..... 198/487.1; 198/483.1; 198/853; 198/801; 242/35.5 A

[58] Field of Search ..... 198/651, 482, 484, 792, 198/852, 853, 801, 347, 460; 242/35.5 A; 57/270, 198

[56] References Cited

U.S. PATENT DOCUMENTS

| | | | |
|---|---|---|---|
| 913,285 | 2/1909 | Harbek | 198/482 |
| 1,136,578 | 4/1915 | Ayres | 198/853 |
| 1,979,129 | 10/1934 | Whitmer | 198/482 X |
| 2,051,090 | 8/1936 | Ladewig et al. | 198/482 X |
| 3,231,069 | 1/1966 | Lanham | 198/853 |
| 3,289,814 | 12/1966 | Rosema | 198/482 |
| 3,294,217 | 12/1966 | Kay | 198/801 X |
| 3,608,699 | 8/1971 | Voris, Jr. | 198/651 X |
| 3,722,743 | 3/1973 | Atchley | 198/801 X |
| 4,050,323 | 9/1977 | I'Anson | 198/853 |
| 4,080,842 | 3/1978 | Lapeyre et al. | 198/853 X |

*Primary Examiner*—Joseph E. Valenza
*Assistant Examiner*—Michael Stone
*Attorney, Agent, or Firm*—Herbert L. Lerner; Laurence A. Greenberg

[57] ABSTRACT

A bobbin tube magazine assembly, includes:

a bobbin tube feeding device;

a bobbin tube conveyor connected to the bobbin tube feeding device, the bobbin tube conveyor being controlled by the bobbin tube feeding device for discharging bobbin tubes from the bobbin tube conveyor to the bobbin tube feeding device and the bobbin tube conveyor being independently actuatable for circulating bobbin tubes;

the bobbin tube conveyor including:

at least one endless pulling device, slip-on arbors protruding from the pulling device, each of the arbors having an end distant from the pulling device for receiving bobbin tubes, the arbors passing through a location during circulation in which the arbors point below the horizontal, as seen in direction toward the ends of the arbors, sliding guides disposed adjacent the ends of the arbors at the location for preventing bobbin tubes from slipping off the arbors, a freely accessible bobbin tube filling location, and a bobbin tube discharge location;

and a discharge device disposed at the discharge location for discharging bobbin tubes from the bobbin tube conveyor to the bobbin tube feeding device.

15 Claims, 10 Drawing Figures

BOBBIN TUBE MAGAZINE

The invention relates to a bobbin tube magazine for the bobbin tube feeding device of a textile machine producing bobbins. Cross-wound bobbins are produced, for instance, on winding machines or on open-end spinning machines. A starter bobbin winding machine upstream of the open-end spinning machine also produces cross-wound bobbins which, however, initially have a limited number of turns. All of these machines must be supplied with bobbin tubes continuously. The bobbin tubes may be completely unwound winding bodies, or winding bodies which already have starter turns or partial windings, from which a cross-wound bobbin of given size is then later produced.

It is already known in the art to assign a bobbin tube feeding device to a textile machine producing such cross-wound bobbins. A bobbin tube feeding device may be provided, for instance, at each individual winding station. It is also conventional to assign a bobbin tube magazine to such a bobbin tube feeding device. Such a bobbin tube magazine is usually in form of a cartridge magazine. The individual bobbin tubes lie against each other and on top of each other; they are taken from the bobbin tube magazine individually from below. This has various disadvantages. Sensitive bobbin tubes rub against each other and previously smooth tubes are roughened unnecessarily, so that they are then no longer suitable for sensitive threads. If the bobbin tubes were previously rough and had a good feel so that coarser yarns would stick better upon starting, their surfaces might become excessively smooth, in some circumstances. If the bobbin tubes carry starter windings or first windings, the wound-up material is damaged directly by contact and friction between the bobbin elements and the windings. In addition, the bobbin tubes may jam in their magazine so that they can no longer be taken out from below under the influence of gravity.

On the other hand, bobbin sleeve magazines are also used in openend spinning machines in which each individual bobbin tube lies in a dish. The bobbin tube magazine itself is then constructed in the form of an elevator. Besides the disadvantages described above, a further disadvantage results in this case because the packing density of the bobbin tubes is insufficient. Either a large magazine must be set up so that a sufficiently large number of bobbins is kept as a supply, or a bobbin tube supply which may be too small under some conditions may have to be used if the space is limited.

It is accordingly an object of the invention to provide a bobbin tube magazine which overcomes the hereinafore-mentioned disadvantages of the heretofore-known devices of this general type, and to provide a bobbin tube supply which is so large and in which the bobbin tubes are so densely packed and ordered even under limited space conditions, that an automatic winding operation which is as free of trouble and maintenance as possible can be provided, and yet a gentle treatment of the bobbin tubes in ensured and mutual contact is avoided.

With the foregoing and other objects in view there is provided, in accordance with the invention, a bobbin tube magazine assembly, comprising:

a bobbin tube feeding device of a textile machine producing bobbins;

a bobbin tube conveyer connected to the bobbin tube feeding device, the bobbin tube conveyer being controlled by the bobbin tube feeding device for discharging bobbin tubes from the bobbin tube conveyer to the bobbin tube feeding device and the bobbin tube conveyer being independently actuatable for circulating bobbin tubes; the bobbin tube conveyor including:

at least one endless pulling device, slip-on arbors protruding from the pulling device, each of the arbors having an end distant from the pulling device for receiving bobbin tubes, the arbors passing through a location during circulation in which the arbors point below the horizontal, i.e. straight down or down at an angle, as seen in direction toward the ends of the arbors, sliding guides disposed adjacent the ends of the arbors at the location, for preventing end faces of bobbin tubes from slipping off the arbors, a freely accessible bobbin tube filing location, and a bobbin tube discharge location;

and a discharge device disposed at the discharge location for discharging bobbin tubes from the bobbin tube conveyer to the bobbin tube feeding device.

The pulling means may be an endless belt, for instance, which is provided with the slip-on arbors and which runs over deflection rolls, one of which can be driven. The bobbin tube conveyer has a functional connection to the bobbin tube feeding device for discharging. The conveyer can be stopped at any time, such as for delivering one or more bobbin tubes to the bobbin tube feeding device. However, the conveyer can be independently switched to circulating operation and can be supplied with bobbin tubes while revolving or during shutdown. This may be done by hand or automatically. After the pulling means of the bobbin tube conveyer have gone through one revolution, for instance, the bobbin tubes which were not taken out appear again at the filling location, and gaps already present because of removals, can be refilled with bobbin tubes again.

If the bobbin tube magazine is to be amply filled at the beginning of a maintenance-free shift, it is merely necessary to switch the bobbin tube conveyer independently to "circulation" and to fill it with bobbin tubes until no empty spaces or practically none are available in the bobbin magazine. If a demand for bobbin tubes occurs at the textile machine during this activity, the bobbin tube feeding device will stop the bobbin tube conveyer briefly, will take the necessary number of bobbin tubes out of the bobbin tube magazine and will then turn on the bobbin tube conveyer again. This removal process basically does not interfere with the filling process at the filling location.

If heavier bobbin tube removal from the bobbin tube magazine sets in, or if the removal quantity per unit time is already almost as large as the filling quantity per unit time, it may be particularly advantageous if, in accordance with another feature of the invention, the discharge location is spaced from the filling location by a distance equal to at least half of the total length of the pulling device, in travel or movement direction of the bobbin tube conveyer. In this case, care may be taken through replenishing to ensure that a considerable bobbin tube supply is available in the section between the filling location and the discharge location. This supply has a buffer effect in case the removal actually exceeds the replenishing temporarily.

Furthermore, in the event of a change in lots or upon a new supply of bobbin tubes, it is advantageous for an especially large number of bobbin tubes to be present in the magazine between the filling location and the discharging location, in the direction of motion of the bobbin tube conveyer. It is well known that when starting a textile machine producing cross-wound bobbins, a particularly large demand for bobbin tubes occurs which is reduced when the bobbin tube supply provided between the filling location and the discharge location is almost used up. If the filling process cannot keep pace with the bobbin tube removal during this time, gaps, i.e., unoccupied slip-on arbors on the bobbin tube conveyer, must then come into the vicinity of the bobbin tube feeding device. However, the harm which this causes decreases in proportion to the magnitude of the supply of bobbin tubes which were present before between the filling location and the discharging location.

Although the above-mentioned belt, or even serrated belt, can serve as the pulling means, it is nevertheless particularly advantageous if, in accordance with a further feature of the invention, the pulling device is formed of at least one parallel transport chain having links carrying the arbors. Such conveyer chains can be assembled individually and with different lengths from the individual chain links. This also simplifies keeping an adequate stock. Individual chain lengths are also more simple to produce than belts or serrated belts of different size.

There must be assurance at the filling location that the bobbin tubes can be slipped on easily without the danger of them slipping off the slip-on arbors again, such as due to bouncing. The slip-on arbors should therefore be as thin as possible so that the bobbin tubes are not tight or even jammed thereon. In addition, it is advantageous if, in accordance with an added feature of the invention, the arbors are inclined upward at the filling location relative to the pulling device. In this case there is hardly any danger of the bobbin tube being able to slide off or bounce back. The same effect, or even a better one, is obtained if, in accordance with an additional feature of the invention, the arbors each have an extension at the end thereof facing upward at the filling location. The slip-on arbor itself may be horizontal at the filling location. This brings a further advantage, since if the discharge is located at the section of the pulling means running in the opposite direction, the extensions point downward at the discharge location and thus enable the bobbin tube feeding device to push the bobbin tubes off the slip-on arbors, such as by means of levers, without interference by the inclined position or projections of the slip-on arbors.

In accordance with again another feature of the invention, each of the chain links have posts or joint pins at an end thereof and straps at another end thereof, the straps having holes formed therein for receiving the posts or joint pins of the adjacent chain link, and stops formed on the chain links for limiting backward flexing of the transport chain when elongated. A chain link constructed in accordance with this feature requires no further connecting means except possibly joint pins. However, if the chain link carries posts, not even joint pins are necessary. It is therefore possible to assemble chains of any length from chain links of completely identical construction. The above-mentioned stops are provided in order to limit the mobility of the transport chain inasmuch as it should be able to run over chain wheels, but it should not be able to give way backward in the elongated condition, if bobbin tubes are slipped on from the front at the filling location. The stops may be formed, for instance, of cross pieces which are placed on the chain links and the ends of which are adjacent each other if the conveyer chain is elongated. These cross pieces may also support the slip-on arbors.

In accordance with again a further feature of the invention, at least the straps of the chain links or the entire chain links are elastically resilient. This is to facilitate the assembly of the chain from individual chain links. Special fixtures or particular force should not be necessary for this purpose. This is particularly important in case posts are provided at the chain links instead of joint pins that must be inserted.

Advantageously, the support points are separated from the joints at the posts or joint pins, so that, in accordance with again an added feature of the invention, the bobbin tube conveyer includes chain wheels, and the chain links each have a support location on the posts or joint pins for engaging the chain wheels, and a joint forming a connection to the adjacent chain link downstream thereof.

In the interest of high packing density and convenient charging at the filling location, and to permit large removal quantities per unit time, several conveyer chains are disposed side by side, perhaps four to six chains. It is advantageous in this case if, in accordance with again an additional feature of the invention, the chain links have straps at an end thereof, at least one common joint pin passing through a hole formed in the straps of a plurality of the chain links, and stops formed on the chain links for limiting backward flexing of the transport chain when elongated. The common joint pins ensure exact synchronism. In this case support points for the engagement of a chain wheel to the joint pin are only necessary at the outer conveyer chains. Therefore, in accordance with still another feature of the invention, the transport chain includes inner and outer transport chain members, the bobbin tube conveyer includes chain wheels, and the joint pin has a support location for engaging the chain wheels at the outer transport chain member.

In order to reduce friction, in accordance with still a further feature of the invention, the chain links include rollers disposed at the support locations for engaging the chain wheels.

In this case, the roller rotates on the post or the joint pin. The roller itself can again be in the form of an antifriction bearing.

The assembly of the chain links to form conveyer chains is particularly easy to accomplish if, in accordance with a concomitant feature of the invention, the straps or posts have bevelled edges formed thereon facing toward the next chain link disposed downstream or upstream, respectively, thereof in circulation direction of the chain links for slideably guiding the chain links into meshing engagement. A chain can then be formed in such a manner that the chain links are placed one behind the other in a chest and made to snap-in together by slight pressure in the longitudinal direction of the chain. The chain links can then no longer be detached from each other under specified stress conditions.

Other features which are considered as characteristic for the invention are set forth in the appended claims.

Although the invention is illustrated and described herein as embodied in a bobbin tube magazine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
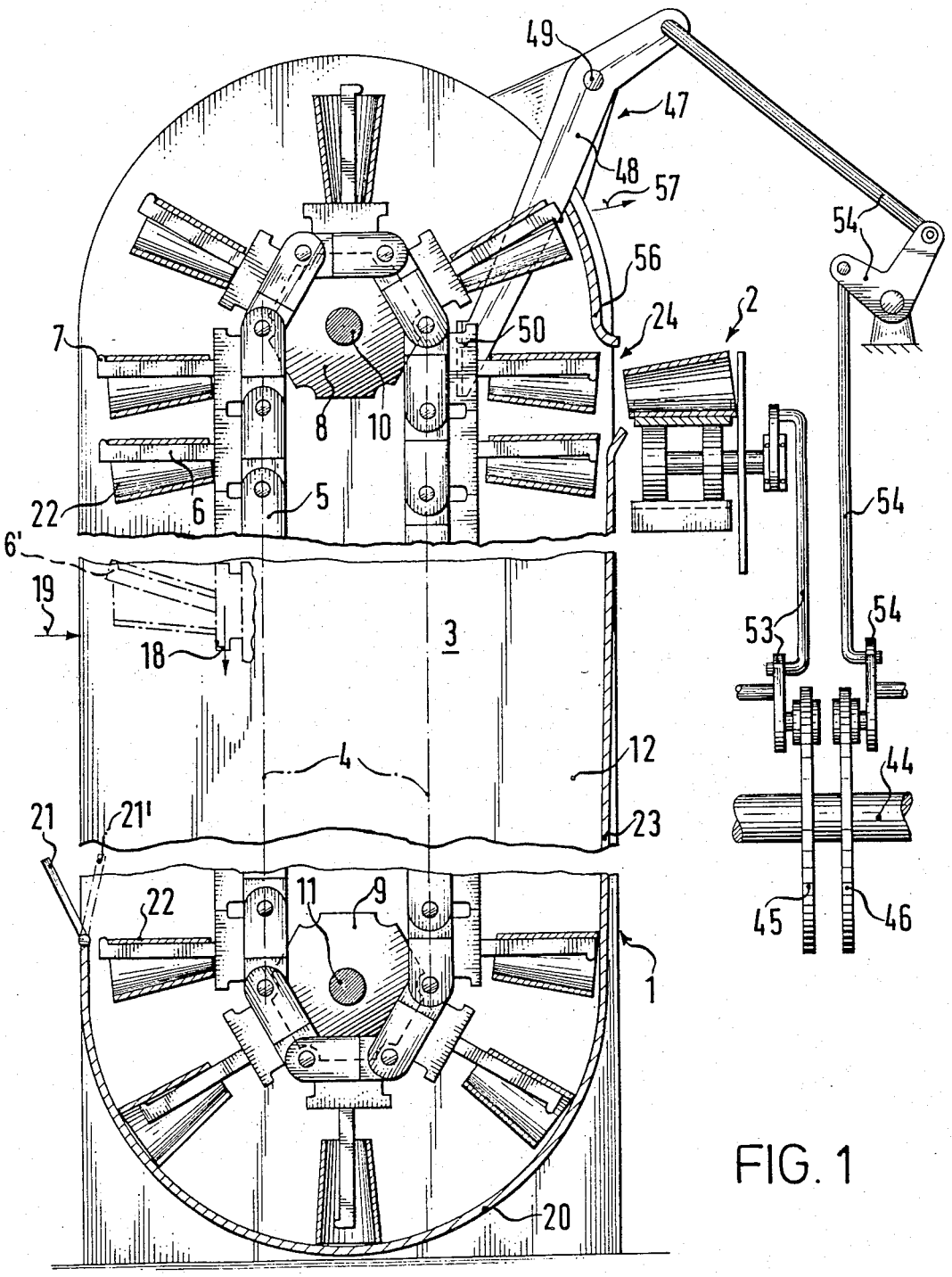
FIG. 1 is a fragmentary, diagrammatic, side-elevational view of a bobbin tube magazine, which is partly broken away.

Referring now to the figures of the drawing in detail and first particularly to FIG. 1 thereof, is seen a bobbin tube magazine designated with reference numeral 1, that is stationed next to an OE (open end) spinning machine which is not shown in its entirety in the drawing. Only a bobbin tube feeding device 2 of a starter bobbin winding device of the spinning machine is reproduced in the drawing. The bobbin tube winding device winds a number of thread turns in crosswise layers on each bobbin tube presented, and passes on the starter bobbin obtained in this manner to the winding stations of the OE spinning machine.

The bobbin tube magazine 1 contains a bobbin tube conveyer designated in general with reference numeral 3. The bobbin tube conveyer 3 has four endless pulling means which extend parallel to each other and are formed of transport chains 4. Each transport chain 4 is formed of similar chain links 5 and each chain link 5 carries a slip-on arbor or mandrel 6 which extends away from the pulling means and has an extension 7 at the end thereof.

The pulling means or transport chains 4 travel on the top and on the bottom thereof over chain wheel sets 8 and 9, respectively. The chain wheel set 8 is mounted on a shaft 10 and the chain wheel set 9 is mounted on a shaft 11. The two shafts are supported in walls 12 (the wall at the front of the device has been removed). According to FIG. 2, the shaft 10 is driven by a motor 13. The motor 13 can be switched on and off by a main switch 14. However, it is only possible to switch on the motor 13 if a cam switch 15 is closed, which interconnects leads 16 and 17.

If the motor 13 is switched on, the pulling means 4 move in the direction of the arrow 18. A filling location 19 is indicated by an arrow between the upper most and lower most slip-on arbors which are at deflection points in FIG. 1. The filling location 19 extends from the upper end of a descending section to near the lower deflection point. The arbors may be pointed upward at the filling location 19, as shown by arbor 6' in phantom in FIG. 1. A vane 21 is provided, which extends over the entire width of a sliding guide 20 in order to facilitate entry of slipped-on bobbin tubes 22 to the deflection point. The sliding guide 20 prevents the bobbin tubes 22 from sliding off the slip-on arbors 6 in vicinity of the lower deflection point.

If, on the other hand, the bobbin tube conveyer 3 is driven in the opposite direction, it is advantageous to bring the vane 21 into the position 21'. In this position, the vane 21 is capable of again pushing bobbin tubes 22 which have already slid over the extension 7, entirely onto the slip-on arbors 6.

Following the sliding guide 20, a wall 23 is located on the back and ends at a discharge point 24 which is indicated by an arrow. The bobbin tube magazine 1 is free of covers at the upper deflection point. The discharge point 24 is located very close to the upper deflection point.

Figure 3:
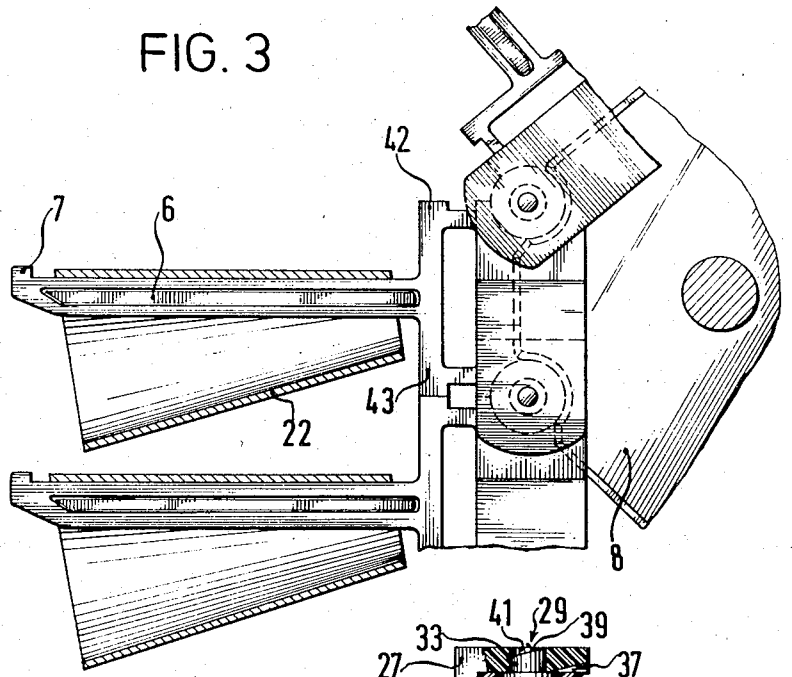
FIGS. 3, 4 and 5 are fragmentary side-elevational, top-plan and front-elevational views, respectively, of parts of a bobbin tube conveyer.
Figure 4:
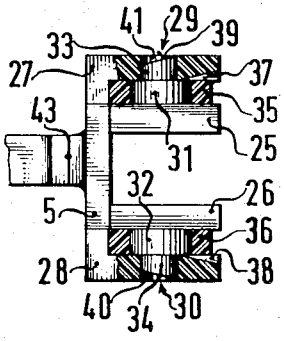
Figure 5:
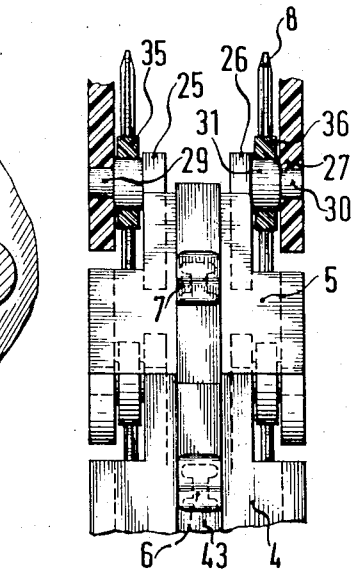

The details of the transport chain 4 are shown particularly clearly in FIGS. 3 to 5. Each chain link 5 has two inner straps 25, 26 at one end and two outer straps 27 and 28 at the other end. The inner strap 25 carries an outwardly pointing post 29 and the inner strap 26 carries an outwardly pointing post 30. FIG. 4 shows that the post has a support point 31 of slightly larger diameter for the engagement of a chain wheel and a joint 33 located somewhat further out which has a somewhat smaller diameter and forms a connection to the next chain link. Similarly, the other post 30 has a support point 32 and a joint 34. The support point 31 is provided with a slipped-on roller 35 and the support point 32 is provided with a slipped-on roller 36.

The chain links 5 are constructed in such a way that they can intermesh with each other. For this purpose, the straps 27 and 28 have chamfers 37 and 38, respectively, facing toward the posts 29, 30 of the next following chain link, and the posts 29 and 30 have chamfers 39 and 40 facing toward the outer straps 27, 28 of the preceding chain link, as guiding and sliding surfaces for the assembly operation.

Holes 41 formed in the straps 27 and 28 fit the outer diameters of the joints 33 and 34 of the posts 29 and 30. In addition, stops 42 are provided on the chain links to limit the deflection of the transport chain 4 rearward in the elongated condition. The stops 42 are formed by end faces of cross pieces 43 which are connected to the chain links. The cross pieces 43 also carry the slip-on arbors 6.

In the embodiment of FIGS. 1–5, the chain links 5 with their cross pieces 43 and the slip-on arbors 6, are each in the form of an injection-molded plastic part. All of these injection-molded parts are of identical construction, so that only a single injection mold is required for manufacturing them. The inserted or slipped-on rollers 35 and 36 are constructed in the form of annular parts which are punched out of a sheet of plastic.

As is best seen in FIG. 1, the starter bobbin winding device which receives the individual bobbin tubes 22 that are sequentially fed to it by means of the bobbin tube feeding device 2, is not shown in detail but a control shaft 44 controls the operating cycle of the starter bobbin winding device and it also controls the operating cycle of the bobbin delivery at the bobbin tube feeding device 2, through a cam 45. At the same time, the control shaft 44 additionally controls a discharging device 47 which is located at the discharge point 24, through a cam 46. The discharging device 47 has two-armed levers 48 which are mounted on a common pivotable shaft 49 and can therefore be rotated together. At the lower ends of the lever 48, wiper straps 50 are provided which are capable of simultaneously pushing down a total of up to four bobbin tubes from the slip-on arbors and of placing them in receiving dishes 51 of the bobbin tube feeding device 2, seen in FIG. 2. The bobbin tube feeding device 2 has a stepping mechanism 52 which is controlled by a lever configuration 53 through the cam 45. Similarly, a functional connection exists from the cam 46 to the discharging device 47 through a lever configuration 54.

Figure 2:
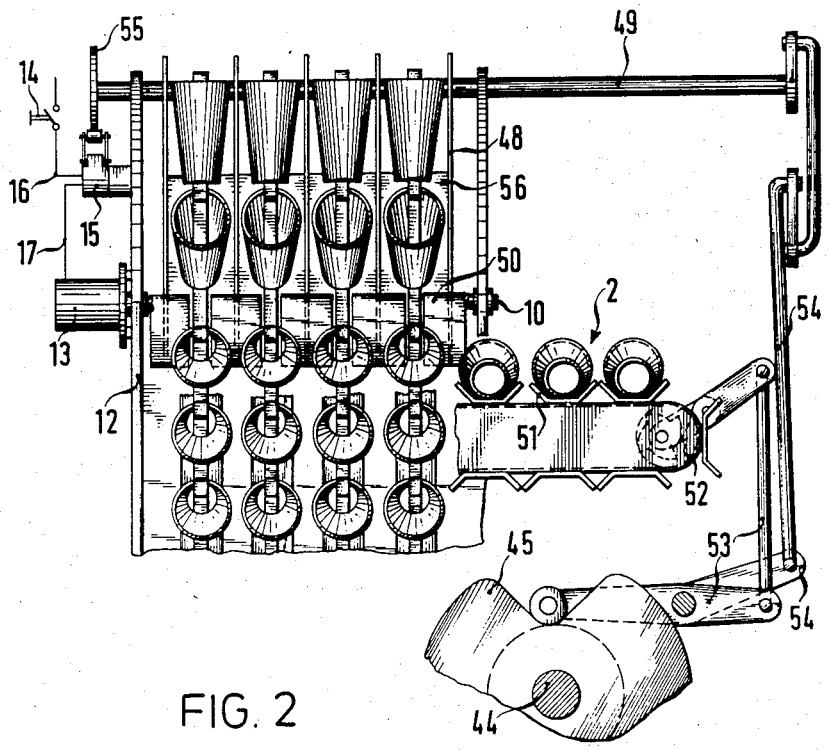
FIG. 2 is a fragmentary, front-elevational view of a filling location and parts of the bobbin tube feeding device.

FIG. 2 shows that a small cam 55 is mounted at the end of the pivotable shaft 49, which serves the purpose of controlling the cam switch 15. Even if the shaft 49 only moves very slightly from its rest position, the cam switch 15 will be opened. At all times, the cam switch 15 will only be closed if the shaft 49 is exactly in the rest position.

The bobbin tube magazine 1 may already be filled before the textile machine starts to operate at all. To this end, the switch 14 shown in FIG. 2 is closed. Since the discharging device 47 is still in its rest position, the cam switch 15 is closed, so that the motor 13 starts. The pulling means 4 of the bobbin tube conveyer 3 are therefore set in motion in the direction of the arrow 18. The slip-on arbors 6 initially do not carry bobbin tubes. The bobbin tubes 22 are then slipped onto the slip-on arbors 6 at the filling location 19. This can be done by hand, for instance. The slip-on arbors 6 are so thin that bobbin tubes of different inner diameters can be used. The diameter, shape and dimensions of the bobbin tubes depend on the lot to be processed by the textile machine.

The operating speed of the pulling means 4 is adjustable. The operating speed depends primarily on the rate of removal, which takes place later. For particularly high operating speeds, or if there is a hesitation in replenishing bobbin tubes, such as because a supply box has just become empty, individual slip-on arbors or entire rows can remain unoccupied during the first pass. However, this does no harm because the bobbin tube conveyer 3 revolves and the unoccupied slip-on arbors appear again from above. Even after two revolutions, it can be seen at the filling location 19, whether or not the bobbin tube magazine 1 is filled completely. If the tubes are not slipped on fast enough, the bobbin tube conveyer 3 can also be stopped inbetween.

If the textile machine producing cross-wound bobbins then starts to operate, i.e., if in the embodiment of FIGS. 1–5 the starter bobbin winding device begins to operate, the activity of the bobbin tube feeding device 2 and the activity of the discharging device 47 also begin of necessity. At the start of the rotary motion of the pivotable shaft 49, the cam switch 15 is opened, so that the bobbin tube conveyer 3 comes to a standstill. Then, the levers 48 and a guard 56 fastened to the levers, swing in the direction of the arrow 57, while the bobbin tubes 22 which are opposite the receiving dishes 51 of the bobbin tube feeding device 2 are pushed off the arbors 6 and placed in the receiving dishes 51. The discharging device 47 is then swung back into its rest position, so that the cam switch 15 is closed again. The bobbin tube conveyer 3 is thus set in motion again. Even during the short shutdown time of the bobbin tube conveyer 3, bobbin tubes can continue to be slipped-on at the filling location 19. A non-illustrated pilgrim step device or detent can also be provided to additionally ensure that the bobbin tube conveyer 3 always comes to rest in a defined position of the slip-on arbors relative to the bobbin tube feeding device.

Figure 6:
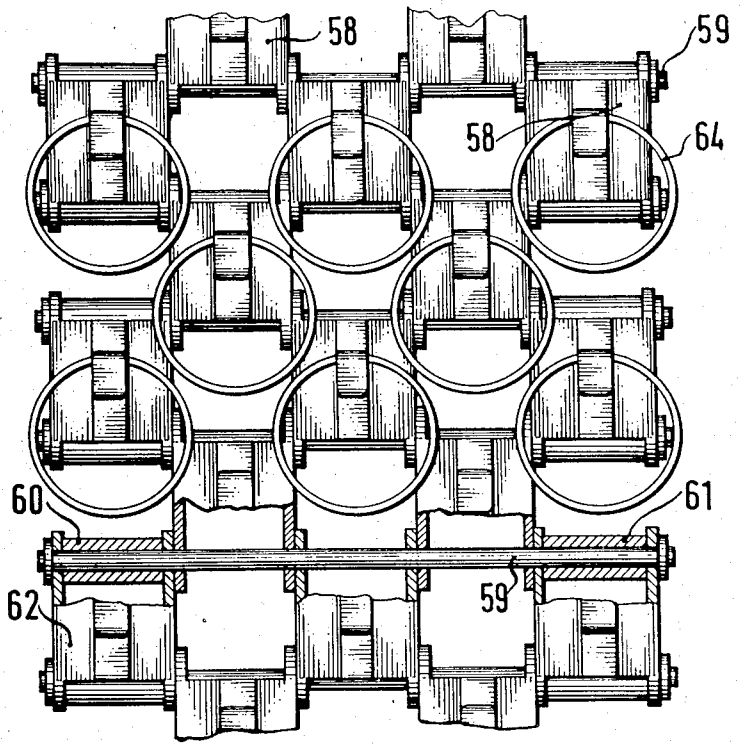
FIG. 6 is a fragmentary front-elevational view of an alternative construction and arrangement of the transport chains of the bobbin tube conveyer.
Figure 7:
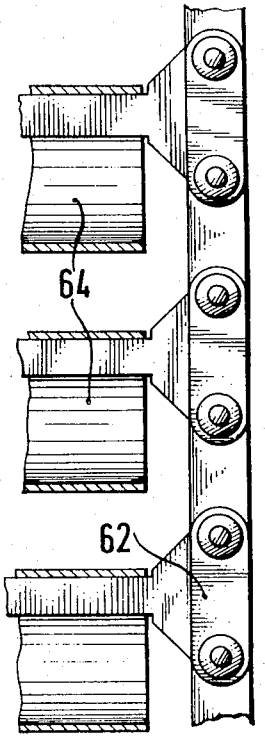
FIG. 7 is a fragmentary side-elevational view of the device according to FIG. 6.

While in the embodiment according to FIGS. 1–5, each transport chain 4 is independent of the adjacent chain, FIGS. 6 and 7 show a somewhat different structure. In the embodiment of FIGS. 6 and 7, a total of five adjacent transport chains 58 with links 62 are connected to each other by common joint pins 59. Support points 60, 61 are provided on the outer transport chains at the joint pins 59, for the engagement of chain wheels. The support points have been formed by slipped-on sleeves. The chain links 62 are also of identical construction in this case. The individual transport chains 58 are offset relative to each other. This results in a higher packing density of the bobbin tubes 64, as is shown particularly in FIG. 6. FIG. 6 also indicates that the connection of successive chain links 62 of the individual transport chains 58 is always accomplished by a chain link or two chain links of adjacent transport chains.

Figure 8:
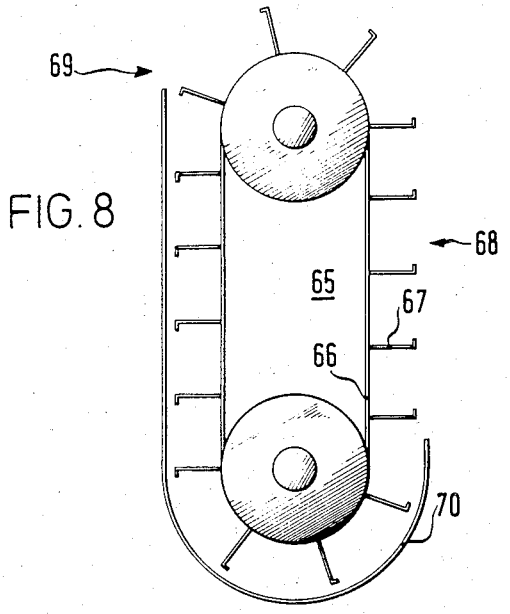
FIG. 8 is a side-elevational view illustrating the basic vertical arrangement of a bobbin tube conveyer.

The principle underlying the apparatus of the invention according to FIGS. 1–5 and according to FIG. 6 is shown once more in FIG. 8. In FIG. 8, the bobbin tube conveyer 65 has pulling means 66 which are provided with slip-on arbors 67 extending outward. The filling location 68 is designated by an arrow, as is the discharge location 69. The sliding guide is designated with reference numeral 70.

Figure 9:
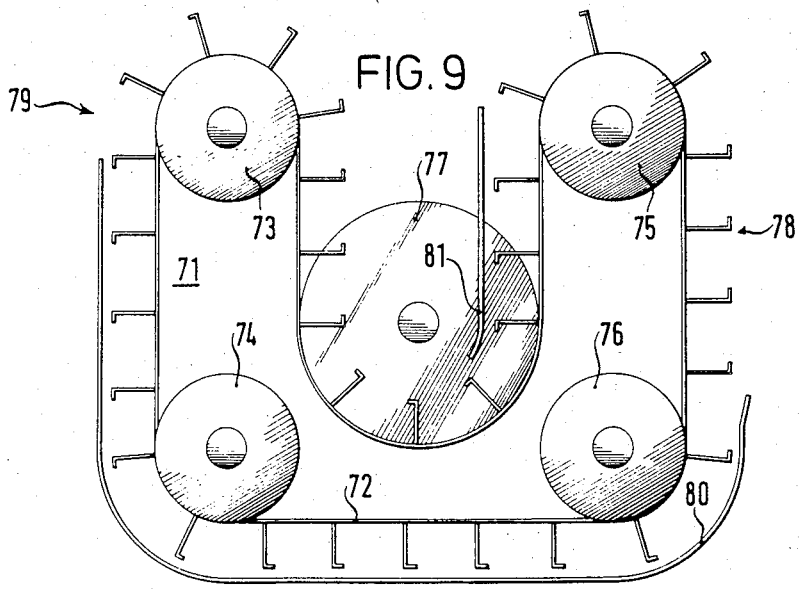
FIG. 9 is a side-elevational view illustrating the basic arrangement of a particularly compact bobbin tube conveyer, which is also suitable for low overall height.
Figure 10:
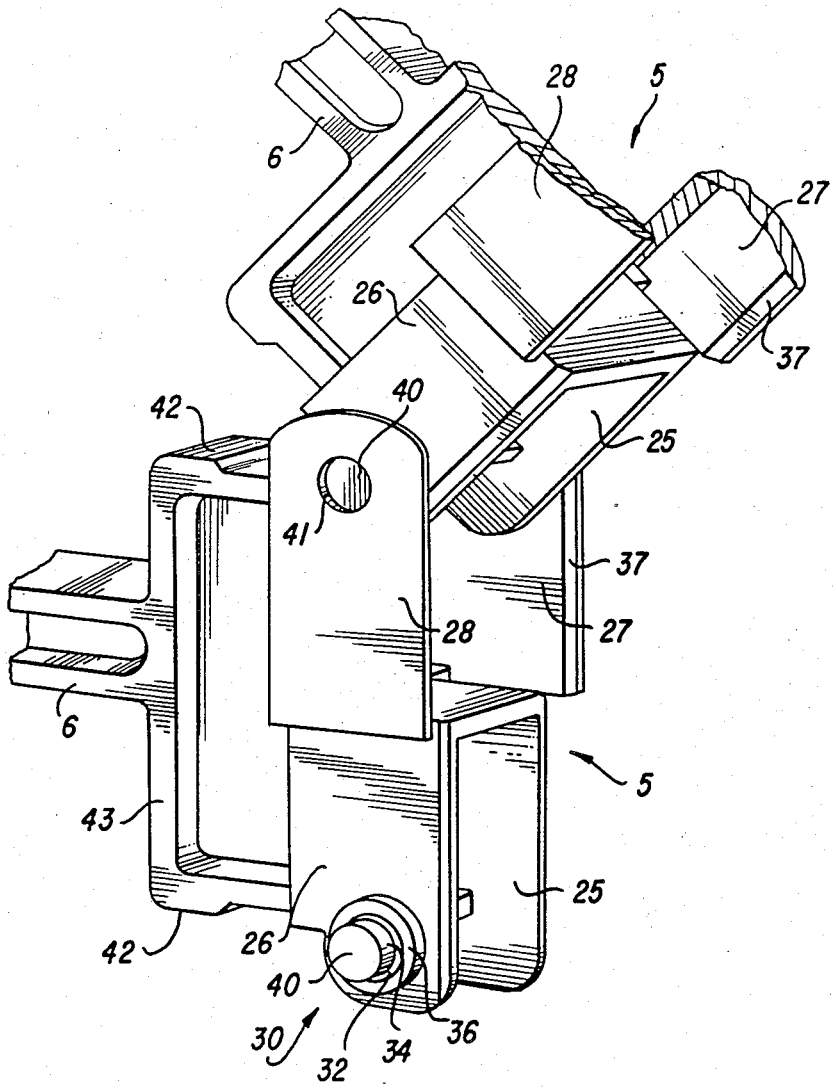
FIG. 10 is a fragmentary perspective view showing the interlocking of two chain links.

Another preferred embodiment is shown diagrammatically in FIG. 9. In the FIG. 9 embodiment, the bobbin tube conveyer 71 has endless pulling means 72 which follow a meander-like course. In order to make this course possible, a total of five deflection points 73 to 77 are provided. A filling location 78 is designated by an arrow as is a discharge location 79. The lower sliding guide 80 is absolutely necessary but the upper sliding guide 81 is not.

The invention is not limited to the embodiments shown and described.

The foregoing is a description corresponding in substance to German Application No. P 32 41 032.8, filed Nov. 6, 1982, the International priority of which is being claimed for the instant application and which is hereby made part of this application. Any discrepancies between the foregoing specification and the aforementioned corresponding German specification are to be resolved in favor of the latter.

We claim:

1. Bobbin tube magazine assembly, comprising:

a bobbin tube feeding device;

a bobbin tube conveyor connected to said bobbin tube feeding device, said bobbin tube conveyor being controlled by said bobbin tube feeding device for discharging bobbin tubes from said bobbin tube conveyor to said bobbin tube feeding device and said bobbin tube conveyor being independently actuatable for circulating bobbin tubes;

said bobbin tube conveyor including:

at least one endless pulling device formed of a plurality of inner and outer transport chains having links, chain wheels for said transport chains, straps each being disposed at an end of a respective one of said chain links, at least one common joint pin passing through a hole formed in said straps of a plurality of said chain links, said joint pin having a support location with an increased diameter for engaging said chain wheels at said outer transport chain, stops formed on said chain links for limiting backward flexing of said transport chain when elongated, slip-on arbors carried by said chain links and protruding from said pulling device, each of said arbors having an end distant from said pulling device for receiving bobbin tubes, said arbors passing through a deflection location during circulation in which said arbors point below the horizontal, as seen in direction toward said ends of said arbors, sliding guides disposed ajacent said ends of said arbors at said deflection location for preventing bobbin tubes from slipping off said arbors, a vane extending over the entire width of said sliding guides, means permitting said vane to move between a first position in which said vane facilitates entry of bobbin tubes at said deflection location and a second position in which said vane pushes bobbin tubes entirely onto said arbors, freely accessible bobbin tube filling location, a bobbin tube discharge location being spaced from said filling location by a distance equal to at least half of the length of said pulling device, in travel direction of said bobbin tube conveyor and a wall disposed between said sliding guides and said discharge location for preventing bobbin tubes from slipping off said arbors;

and a discharge device disposed at said discharge location for discharging bobbin tubes from said bobbin tube conveyor to said bobbin tube feeding device.

2. Assembly according to claim 1, wherein said arbors are inclined upward at said filling location relative to said pulling device.

3. Assembly according to claim 1, wherein said arbors each have an extension at said end thereof facing upward at said filling location.

4. Assembly according to claim 1, wherein each of said chain links have posts at an end thereof and straps at another end thereof, said straps having holes formed therein for receiving said posts of the adjacent chain link, and stops formed on said chain links for limiting backward flexing of said transport chain when elongated.

5. Assembly according to claim 1, wherein each of said chain links have joint pins at an end thereof and straps at another end thereof, said straps having holes formed therein for receiving said joint pins of the adjacent chain link, and stops formed on said chain links for limiting backward flexing of said transport chain when elongated.

6. Assembly according to claim 4, wherein at least said straps of said chain links are elastically resilient.

7. Assembly according to claim 5, wherein at least said straps of said chain links are elastically resilient.

8. Assembly according to claim 4, wherein said bobbin tube conveyer includes chain wheels, and said chain links each have a support location on said posts for engaging said chain wheels, and a joint forming a connection to the adjacent chain link.

9. Assembly according to claim 5, wherein said bobbin tube conveyer includes chain wheels, and said chain links each have a support location on said joint pins for engaging said chain wheels, and a joint forming a connection to the adjacent chain link.

10. Assembly according to claim 8, wherein said chain links include rollers disposed at said support locations for engaging said chain wheels.

11. Assembly according to claim 1, wherein said chain links include rollers disposed at said support locations for engaging said chain wheels.

12. Assembly according to claim 4, wherein said straps have bevelled edges formed thereon facing toward the next chain link disposed downstream thereof in circulation direction of said chain links.

13. Assembly according to claim 5, wherein said straps have bevelled edges formed thereon facing toward the next chain link disposed downstream thereof in circulation direction of said chain links.

14. Assembly according to claim 1, wherein said straps have bevelled edges formed thereon facing toward the next chain link disposed downstream thereof in circulation direction of said chain links.

15. Assembly according to claim 4, wherein said posts have bevelled edges formed thereon facing toward the next chain link disposed upstream thereof in circulation direction of said chain links.

* * * * *